United States Patent [19]

Leitgeb

[11] 4,208,960

[45] Jun. 24, 1980

[54] COMPACTOR

[76] Inventor: Dennis R. Leitgeb, 317 Woodbridge, Grand Blanc, Mich. 48439

[21] Appl. No.: 33,860

[22] Filed: Apr. 27, 1979

[51] Int. Cl.[2] ..... B30B 1/32; B30B 9/32

[52] U.S. Cl. ..... 100/35; 100/DIG. 2; 100/240

[58] Field of Search ..... 100/DIG. 2, 35, 240

[56] References Cited

U.S. PATENT DOCUMENTS

| | | | |
|---|---|---|---|
| 2,150,812 | 3/1939 | Aukerman | 100/DIG. 2 |
| 2,212,047 | 8/1940 | Ross | 100/DIG. 2 |
| 2,563,379 | 8/1951 | Smith | 100/DIG. 2 |
| 2,700,333 | 1/1955 | Polsen | 100/DIG. 2 |
| 3,589,090 | 6/1971 | Dittmer | 100/DIG. 2 |
| 3,946,662 | 3/1976 | Ross | 100/DIG. 2 |

*Primary Examiner*—Billy J. Wilhite

*Attorney, Agent, or Firm*—Basile and Weintraub

[57] ABSTRACT

Apparatus for compacting and storing cans comprises a device for crushing cans and storage and collection containers. The can crushing device comprises a ramming head and linear drive means for raising and lowering the ramming head to crush the cans. The cans are positioned upright, in open topped storage containers, beneath the ramming head. When lowered, the ramming head engages the tops of the cans and applies an evenly distributed force thereon so as to crush the cans with minimum bulging, preserving the tops and bottoms of the cans substantially intact. The storage containers are stackable, having upper and lower portions dimensioned to nest together to permit containers of crushed cans to be stacked and stored conveniently and securely.

6 Claims, 3 Drawing Figures

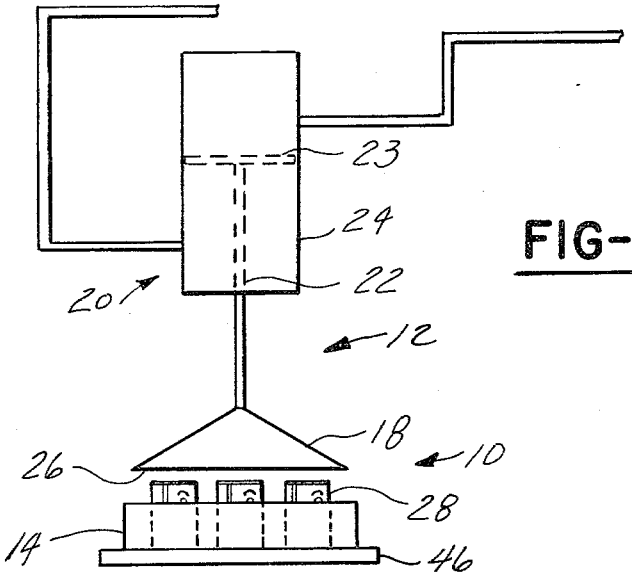
FIG-1
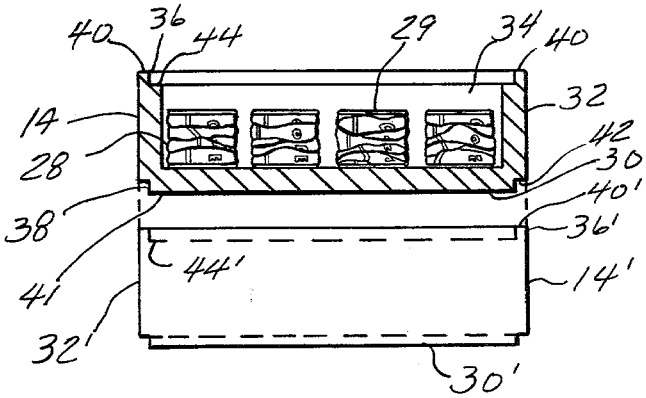
FIG-2
FIG-3
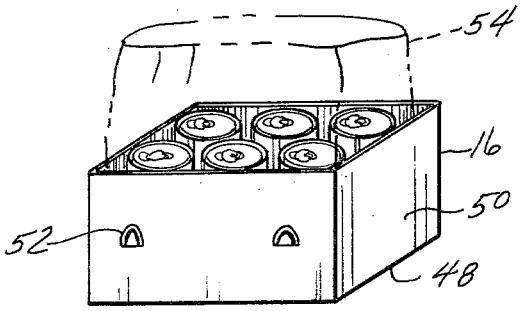

COMPACTOR

BACKGROUND OF THE INVENTION

I. Field of the Invention

The present invention pertains to can compacting and storage apparatus. More particularly, the present invention pertains to apparatus for crushing cans which minimize bulging and preserve the tops and bottoms of the cans substantially intact. Even more particularly, the present invention pertains to devices for crushing cans which minimize bulging, preserve the tops and bottoms of the cans substantially intact and which provide for efficient collection, stacking and storage thereof.

II. Description of the Prior Art

The disposal of cans has long been a subject of environmental concern. Numerous products, and particularly beverages, are sold in cans which generally comprise metal, formed from aluminum or alloys thereof. Such cans occupy a substantial volume, particularly in relation to their weight, and, therefore, are difficult to store efficiently.

A number of devices are known in the art of can disposal with which empty cans are crushed. However, while these known devices compact the volume of cans for storage, they do not significantly improve the manageability of the cans or provide means whereby the cans can be conveniently stacked or stored.

Moreover, in a number of regions, the tops or bottoms of cans display legends reciting information pertinent to the disposition thereof and, in some cases, to a deposit or other arrangement applicable thereto. In these regions it is necessary that the tops and bottoms of the cans be maintained substantially intact and readily accessible during storage to permit inspection and identification.

The compacting devices known in the prior art are ill suited to these requirements. Most can compressors known in the art crush the cans laterally, thereby crushing the top and bottom. Those known devices which crush cans vertically are impractical as they are adapted to crush only one can at a time and in that they do not provide for the maintainence and storage of the crushed cans.

Therefore, significant advantages would be achieved by providing a compacting system which permits a plurality of cans to be crushed simultaneously, preserving substantially intact, the tops and bottoms of the cans for identification purposes. Further benefits would be realized by providing a compacting system which provides for the maintainence and storage of the crushed cans.

III. Prior Art Statement

In the opinion of the applicant, U.S. Pat. Nos. 2,563,379, 2,212,047, and 3,589,090 constitute the most relevant prior art of which the applicant is aware.

SUMMARY OF THE INVENTION

The present invention which will be described subsequently in greater detail comprises apparatus for collecting, compacting, maintaining and storing of empty cans, and particularly for such cans as are commonly used for beverages, constructed from aluminum or aluminum alloys.

The apparatus hereof comprises a compactor and containers for accumulating empty uncrushed cans and for storing crushed cans in an orderly, efficient manner.

The compactor hereof, in its preferred embodiment comprises a ramming head, having a lower, flat can engaging surface, adapted to engage the tops of the cans disposed therebeneath and to apply pressure evenly thereto. The ramming head is driven linearly by a hydraulic press which applies sufficient pressure to the tops of the cans to crush the cans longitudinally. According to the preferred embodiment, pressure is exerted through the ramming head until the tops of the cans have reached a predetermined height at which the cans are compacted and their volume reduced sufficiently for convenient handling but at which the compression of the height of the cans has not yet resulted in appreciable bulging of the sides.

According to the preferred embodiment, storage containers are provided in which cans are positioned upright, beneath the ramming head for crushing. The containers are provided with upper and lower portions dimensioned to nest together to facilitate stacking and storage.

Further, according to the preferred embodiment, a collection container for empty cans is provided wherein empty cans may be accumulated efficiently for compacting in accordance herewith.

It is therefore a primary object of the present invention to provide a compactor for empty cans which crushes a plurality of cans simultaneously, preserving substantially intact, the tops and bottoms thereof for identification purposes.

It is a further object of the present invention to provide a compacting apparatus comprising a storage container in which cans are crushed and stored and a collection container in which cans are accumulated efficiently. Other advantages and applications of the present invention will become apparent to those skilled in the art when the accompanying description of the present invention is read in conjunction with the accompanying drawings.

BRIEF DESCRIPTION OF THE DRAWINGS

The description herein makes reference to the accompanying drawings wherein like reference numerals refer to like parts throughout the several views in which:

FIG. 1 is a front elevational view of the compacting device and storage container hereof;

FIG. 2 is a front sectional view of stacked storage containers;

FIG. 3 is a front perspective view of the portable container hereof partially in phantom.

DESCRIPTION OF THE PREFERRED EMBODIMENT

Referring now to the drawings and in particular FIG. 1, there is illustrated generally at 10 apparatus for compacting and storing cans. The apparatus, 10, comprises a curshing device, indicated generally at 12 and storage containers, such as that indicated at 14. The apparatus further comprises a collection container for accumulating empty cans to be crushed, illustrated in FIG. 3 at 16.

The crushing device 12 comprises a ramming head 18 which is driven linearly by any suitable drive means, preferably an hydraulic press 20.

The hydraulic press hereof, 20, is motor driven and of the conventional construction, well known to the skilled artisan, in which a piston rod 22 is selectively raised and lowered within a cylinder 24 by pressure exerted by fluid pumped into the cylinder respectively beneath and above the piston head 23.

The ramming head 18 is coupled, to the piston rod 22 by any suitable coupling means and is configured to distribute pressure evenly over an engaging surface area. Preferably, the ramming head 18 has a conical configuration, a flat bottom surface 26 and is coupled to the piston rod at its apex. Through this construction, the downward pressure exerted by the hydraulic press 20 through the piston rod 22, and the ramming head 18 is distributed evenly over the tops of the cans 28 disposed therebeneath.

The hydraulic press 20 of the preferred embodiment exerts sufficient pressure through the ramming head, to enable the crushing device 12 to crush a plurality of metal cans simultaneously. Accordingly, the lower surface 26 of the ramming head 18 is of sufficient area to cover a plurality of cans 28 deployed therebeneath. It is to be understood that the present crushing device 12 may be adapted to compact any number of cans desired; however, in view of the popularity six, eight and twelve can packaging, it is particularly convenient to provide storage containers configured to receive twenty-four cans for compacting and storing.

According to the present invention, the cans 28 to be crushed are aligned upright beneath the ramming head in the storage container 14. The storage container 14 is an open topped structure having a floor 30 and four upstanding sidewalls 32. The open top 34 of the container 14 has a surface area sufficiently large to receive the ramming head during the crushing operation. It is to be understood that the container is sufficiently large to receive twenty-four cans which are slightly spaced apart to accommodate the small degree of bulging which occurs during the crushing process. To obtain optimum space efficiency, the storage containers 14 are shallow, having a height shorter than that of an uncrushed can. The storage container 14 may be constructed from any suitably durable material such as wood or metal.

The storage containers 14 are further provided with stacking means on the upper and lower portions thereof which are dimensioned to interengage and nest with the containers deployed above and below to facilitate stacking and storage.

In the preferred embodiment, and as shown in FIG. 2, the upper and lower portions of the side walls 32 are provided with reduced diameter sections, 36 and 38 at the upper edges 40 and lower edges 41 thereof, respectively. The lower reduced diameter sections 38 are provided at the inner portions of the side walls 32 such that an exterior ledge 42 is formed about the lower perimeter of the container.

Similarly, the upper edges 40 of the sidewalls 32 are provided with reduced diameter sections 36 at their exterior portions such that a ledge 44 is formed at the upper interior perimeter of the container 14.

In this manner, a first, upper container, 14 may be nested into a second, lower container, 14', the reduced diameter section 36' of the upper edges 40' of the sidewalls 32' of the second container 14' abutting and supporting the lower, exterior ledge 42 of the upper container 14, and the upper, interior ledge 44' of the lower container abutting and supporting the lower edges 41 of the sidewalls of the upper container 14.

In the preferred method for practicing the present invention, twenty-four cans 28 are placed upright within the storage container 14, beneath and in alignment with ramming head 18. Preferably, the crushing device is provided with a platform 46 for seating the storage container directly beneath the ramming head. When the cans are in position, the motor (not shown) is engaged and the hydraulic press operated to drive the ramming head 18 linearly downward. As the ramming head 18 descends, the lower surface 26 of the ramming head 18 engages the tops 29 of the cans 28 and exerts sufficient pressure thereon to cause the crush cans 28. The pressure is continued until the cans have been crushed to a predetermined height which is shorter than that of the storage container, as shown in FIG. 2. It is to be appreciated that the pressure exerted on the cans 28 by the ramming head is distributed evenly thereover. The tops 29 of the cans 28 therefore sustain only minimum damage during the crushing operation and are therefore preserved substantially intact as are the bottoms of the cans which are pressed evenly against the floor 30 of the container 14.

It is to be appreciated that preserving the integrity of the tops and bottoms of the cans is of utmost importance to store keepers and others engaged in handling returnable cans. Cans in many regions bear legends on their tops which recite such information as applicable deposit amounts or instructions for disposition. It is therefore often required that the tops of cans be preserved sufficiently intact to insure that such information is accessible and legible. The present invention provides a means for compacting and storing cans efficiently, while preserving the required integrity of the can top and bottoms.

As the cans are crushed within the storage container 14 and as the crushed cans are arranged upright within the storage container, 14, with the tops easily viewed, handling of the cans is minimized. The storage containers 14, having the crushed cans therein, may then be stacked efficiently.

Now, with reference to FIG. 3, there is depicted therein a collection container 16 adapted for accumulating cans to be compacted in accordance herewith. The collection container 16 is dimensioned to receive six beverage cans in an upright orientation. In the preferred embodiment, the collection container 16 comprises a floor 48 and four upstanding sidewalls 50. If desired, the container 16 may be provided with a lid (not shown). Hanging means 52 such as hooks or brackets are provided on a sidewall 50 to permit the container 16 to be hung on a wall. The container 16 may be further provided with carrying means such as handles to permit the container to be transported easily.

Disposable bags 54 are provided for insertion into the top of the container 16 to form a liner therewith. In this manner, the cans may be assembled neatly and efficiently in a vertical orientation, within the lined container 16. When six cans have been collected, the disposable bag 54 containing the cans may be removed, maintaining the cans neatly in their vertical orientation, for transport. A new bag may then be inserted into the device 16 and additional cans accumulated therein.

It is to be appreciated from the preceding that there has been described herein an apparatus for compacting and storing cans. The present invention is amenable to a variety of applications all falling within the scope and spirit hereof.

Having thus described the invention, what is claimed is:

1. An apparatus for compacting and storing empty cans which comprises:

(a) a crushing device comprising a ramming head having a flat bottom surface and means for linearly driving the ramming head, and (b) a plurality of open topped storage containers adapted to receive a plurality of cans in an upright orientation for crushing the storage containers comprising a floor, and sidewalls having upper and lower edges, the storage containers being provided with means for nesting with containers deployed thereabove and therebeneath to facilitate stacking thereof, and wherein the open topped storage containers are dimensioned to receive the ramming head, such that when a storage container having a plurality of cans deployed upright therewithin is positioned beneath the ramming head, the ramming head may be lowered by the linear driving means to engage the tops of the cans and crush the cans downward into the container to a predetermined height therewithin, such that the tops of the cans are preserved substantially intact.

2. The apparatus of claim 1 wherein the ramming head has a conical configuration.

3. The apparatus of claim 1 wherein the means for driving the ramming head comprise an hydraulic press.

4. The apparatus of claim 1 wherein the means for nesting comprises reduced diameter sections provided at the upper and lower edges of the container sidewalls and upper and lower ledges formed about interior and exterior perimeters of the containers, adjoining the reduced diameter sections such that containers may be nestingly stacked, the lower edges of a first container abutting the upper ledge of a second container deployed therebelow and the upper edges of the second container abutting the lower ledge of the first container, thereabove.

5. The apparatus of claim 1 wherein the crushing device further comprises a platform for seating the storage container directly beneath the ramming head.

6. A method for compacting and storing empty cans in open topped storage containers which comprises the steps of:

(a) positioning a plurality of empty cans in an upright orientation in an open topped storage container, dimensioned to receive therewithin a ramming head, having a flat bottom surface and operably coupled with linear drive means, each storage container being provided with means on upper and lower portions thereof for nesting containers emplaced thereabove and therebeneath, (b) positioning the storage container having the cans positioned upright therewithin beneath the ramming head, (c) operating the linear drive means to drive the ramming head down to engage the tops of the cans and to crush the cans downward into the storage container to a predetermined height therein, preserving the tops of the cans substantially intact, (d) operating the linear drive means to raise the ramming head up, out of the storage container, and (e) stacking the storage container with other storage containers, aligning the nesting means of the storage container to nest with the storage containers deployed thereabove or therebeneath.

* * * * *